United States Patent [19]

Akahori et al.

[11] 4,404,041

[45] Sep. 13, 1983

[54] METHOD OF PRODUCING ELONGATED LARGE-SIZE FORGED ARTICLE

[75] Inventors: Kimihiko Akahori, Katsuta; Shigeo Maeno, Ibaraki; Hideyo Kodama; Norio Morisada, both of Katsuta, all of Japan

[73] Assignee: Hitachi, Ltd., Tokyo, Japan

[21] Appl. No.: 437,537

[22] Filed: Oct. 29, 1982

[30] Foreign Application Priority Data

Nov. 2, 1981 [JP] Japan ..... 56/174635

[51] Int. Cl.[3] ..... C21D 8/00

[52] U.S. Cl. ..... 148/2; 148/12 R; 148/36; 29/527.5; 75/126 F; 75/126 J

[58] Field of Search ..... 148/2, 12 R, 36, 12 EA, 148/37; 29/527.5; 75/126 J, 126 F

[56] References Cited

U.S. PATENT DOCUMENTS

| | | | |
|---|---|---|---|
| 1,150,401 | 8/1915 | Talbot | 148/2 |
| 1,734,930 | 11/1929 | Weaver | 148/12 R |
| 3,139,337 | 6/1964 | Boyle et al. | 148/37 |
| 3,151,979 | 10/1964 | Carney et al. | 148/12 R |
| 4,026,727 | 5/1977 | Finkl et al. | 148/2 |
| 4,286,986 | 9/1981 | Borneman | 148/2 |

FOREIGN PATENT DOCUMENTS

| | | | |
|---|---|---|---|
| 54-146211 | 11/1979 | Japan | 148/12 EA |
| 56-23367 | 3/1981 | Japan | 29/527.5 |

OTHER PUBLICATIONS

Mochel, N. L., "Steels for Turbine Rotor Forgings and their Heat Treatment", Westinghouse Electric & Mfg. Co., Philadelphia, Oct. 1937, pp. 265–269.

*Primary Examiner*—L. Dewayne Rutledge
*Assistant Examiner*—Robert L. McDowell
*Attorney, Agent, or Firm*—Antonelli, Terry & Wands

[57] ABSTRACT

A method of producing forged article by casting a molten alloy steel containing 0.02 to 0.15 wt % of niobium and 9 to 12 wt % of chromium in a metal mold to form an ingot and subjecting the ingot to a forging. The ingot is formed to have a diameter greater than the height thereby to prevent generation of eutectic NbC and sedimental crystals.

22 Claims, 5 Drawing Figures

METHOD OF PRODUCING ELONGATED LARGE-SIZE FORGED ARTICLE

BACKGROUND OF THE INVENTION

1. Field of the Invention

The present invention relates to a method of producing elongated large-size forged article from an alloy steel containing, by weight, 0.08 to 0.25% of carbon, 0.02 to 0.15% of niobium and 9 to 12% of chromium and, more particularly, to a method of producing forged article suited to use as the rotor shaft of a steam turbine.

2. Description of the Prior Art

Known alloy steels used as the material of elongated large-size forged article for use at high temperature, e.g. rotor shaft of a steam turbine, contain about 10 wt% of chromium and a small amount of niobium. Such alloy steels are shown, for example, in the specification of the U.S. Pat. No. 3,139,337.

It proved, however, that elongated large-size forged articles of a length greater than 5 m and a diameter exceeding 500 mm, made from an alloy containing small amount of niobium and about 10 wt% of chromium, often suffers serious deterioration in the mechanical property, particularly in the elongation and reduction of area, due to generation of eutectic niobium carbides in the core portion of the cast ingot during the ingot making. It proved also that sedimental crystals containing non-metallic inclusions are formed undesirably in the lower portion of the cast ingot during the ingot making.

In the production of elongated large-size forged article, the ingot is usually formed so as to have a height which is larger than its diameter, because such a form of the ingot reduces the number of steps in the forging process. More specifically, the ratio H/D of the height H to the diameter D of the ingot, neglecting the hot top portion, is selected usually to range between 1.5 and 2.0, measuring the diameter D at the heightwise mid point of the ingot. In this vertically elongated steel ingot, the solidification in the core portion of the ingot takes place last, so that V-segregation and/or shrinkage cavity are formed in the core portion of the ingot, while sedimental crystals tend to be generated in the lower portion of the ingot. When the ingot is made by means of a metal mold, the V-segregation and shrinkage cavity tend to be formed in large ingots having diameter exceeding 500 mm. The shrinkage cavity is referred to also as loose structure.

Since the influence of the V-segregation and shrinkage cavity are eliminated substantially by the forging, hitherto, it has been an ordinary measure to form and use vertically elongated ingot anticipating the generation of the segregation and/or shrinkage cavity.

On the other hand, the portion of the ingot containing the sedimental crystals is cut and removed because such a portion includes large non-metallic inclusions which adversely affect the mechanical property of the product.

Under this circumstance, a new problem has arisen in which the forged article made from an alloy steel containing small amount of niobium and about 10 wt% of chromium disclosed in the specification of the U.S. Pat. No. 3,139,337 undesirably permits during the ingot making the generation of the eutective niobium carbides in the core portion of the cast ingot in which the solidification occurs later than in other portions to adversely affect the mechanical property of the forged article.

SUMMARY OF THE INVENTION

Objects of the Invention

Accordingly, an object of the invention is to provide a method of producing, from an alloy steel containing about 0.1 wt% of niobium and about 10 wt% of chromium, a cast ingot and a forged article from which the eutectic niobium carbides and sedimental crystals are excluded.

Another object of the invention is to provide a method of producing a rotor shaft of steam turbine from a sound alloy steel.

Statement of the Invention

To this end, according to the invention, there is provided a method of producing an elongated large-size forged article comprising: preparing molten metal of an alloy steel containing 0.08 to 0.25 wt% of carbon, 0.02 to 0.15 wt% of niobium, 9 to 12 wt% of chromium and more than 80 wt% of iron, pouring the molten metal and solidifying the same in a metal mold having a ratio H/D of the height H of the body neglecting the hot top portion to the diameter D at the height of $\frac{1}{2}$ H falling within a range of not greater than 1, and forging the resulting ingot by applying pressure in the radial direction until the heightwise length of a forged article becomes greater than a diameter length of the forged article.

The ingot used in the invention exhibits a greater solidification rate at the radially outer part than at the radially central part, and at the axially lower part than at the axially upper part.

In proved that the ingot in accordance with the invention, having a height to diameter ratio H/D of not greater than 1 as measured at substantially heightwise mid point can effectively avoid the formation of the sedimental crystals. This in turn makes it possible to use whole part of the ingot as the forged article. The portion of the ingot neglecting the hot top portion will be referred to as "body" of ingot, hereinunder. If the alloy steel has a too high niobium content, eutectic niobium carbides often remain in the ingot even if the height to diameter ratio H/D takes a value not greater than 1, so that the upper limit of the niobium content is restricted to 0.15 wt%.

The present inventors have found, through an intense study and experiment, that alloy steels having the following compositions can suitably be used as the material of the rotor shaft of steam turbine: 0.08 to 0.25 wt% of carbon, 0.15 to 0.3 wt% of sum of carbon and nitrogen, not greater than 0.5 wt% of silicon, 0.4 to 1 wt% of manganese, 9 to 12 wt% of chromium, 0.7 to 1.5 wt% of molybdenum, 0.15 to 0.3 wt% of vanadium, 0.02 to 0.15 wt% of niobium and the balance iron and, if necessary, not greater than 1 wt% of nickel. The present invention can be used quite suitably for the production of elongated large-size forged article from, for example, the 12 wt% chromium alloy steel mentioned above.

At least 0.02 wt% of niobium is essential for increasing the mechanical strength of the alloy steel, particularly high temperature strength. A too high niobium content will unfavourably cause eutectic niobium carbides in the ingot, so that the upper limit of the niobium content is selected to be 0.15 wt%. Chromium is essential for increasing the oxidation resistance as well as the strength but tends to form delta ferrite to reduce the impact value, elongation and the reduction of area. The chromium content, therefore, should range between 9 and 12 wt%. Molybdenum and vanadium contribute to the increase in the high temperature strength. The molybdenum content and the vanadium content, however, should be selected to fall within the above-mentioned ranges because they tend to promote the formation of ferrite. Silicon and manganese are the elements which are usually contained in alloy steels of the kind described. The silicon content, however, should be selected to be not greater than 0.5 wt% because an excessively high silicon content promotes the generation of the ferrite to make the material brittle. Although manganese promotes the formation of austenite, the manganese content should also be selected not to be higher than 1 wt% because a too high manganese content will reduce the high temperature strength. The nickel may or not may be contained. When nickel is contained, the nickel content should not exceed 1 wt% because the nickel tends to reduce the high temperature strength although it promotes the austenite stabilization. The carbon, which is an element effective for increasing the strength, tends to increase the amount of carbides to make the material brittle and to reduce the high temperature strength if the carbon content is too high. The carbon content, therefore, should be selected to range between 0.08 and 0.25 wt%. An addition of a small amount of nitrogen serves to increase the high temperature strength. In order to obtain sufficient strength, elongation and reduction of area in good balance, the carbon content and nitrogen content in total should be selected to range between 0.15 and 0.3 wt%.

The alloy steel from which the forged article of the invention is produced should not contain other elements than those mentioned above. If some other elements are contained inevitably, the contents of such elements in total should not exceed 1 wt%.

Both of the phosphorus content and sulfur content are preferably maintained at levels not greater than 0.015 wt%. Particularly, the sulfur content should be selected not to exceed 0.005 wt%, because the sulfur inconveniently promotes the generation of eutectic niobium carbides.

The chromium equivalent of the alloy steel preferably ranges between 5.0 and 6.5. Higher chromium equivalent produces greater amount of delta ferrite to make the material more brittle. To the contrary, a too low chromium equivalent reduces the strength. The chromium equivalent is calculated by employing the following numerical values.

| Chromium Equivalents | |
|---|---|
| Austenite Promoters | |
| C | −40 |
| Mn | −2 |
| Ni | −4 |
| N | −30 |
| Ferrite Promoters | |
| Si | +6 |
| Cr | +1 |
| Mo | +4 |
| W | +1.5 |
| V | +11 |
| Nb | +5 |

The rotor shaft of the steam turbine is produced by a process having the following steps (1) to (8).

(1) Electric furnace refining
(2) Ladle refining
(3) Ingot making
(4) Forging
(5) Annealing
(6) Machining
(7) Hardening/Tempering
(8) Finishing Preferably, a test and inspection are conducted between each successive steps. The practical method and condition for carrying out each step will be explained hereinunder.

(1) Electric furnace refining

The amounts of constituents are adjusted to provide the aimed composition of the alloy steel. The constituents are then molten in an electric furnace and refined. The addition of nitrogen, however, is made in the later period of the next step, i.e. the ladle refining, for otherwise the nitrogen may be released into the atmosphere during the vacuum degassing process.

(2) Ladle refining

The molten metal is further refined within a ladle to get rid of oxygen, sulfur and hydrogen. Preferably, a vacuum degassing is conducted under vacuum of 1 mmHg or less.

(3) Ingot making

The molten metal is poured into and solidified in a metal mold which is shaped and sized to provide a ratio H/D between the height H of the ingot neglecting the hot top portion and the diameter D of the ingot as measured at heightwise mid point, i.e. the point of ½ H from the bottom, of the ingot takes a value not greater than 1. The ratio H/D between the height H and the diameter D preferably ranges between 0.5 and 1.0, more preferably between 0.8 and 1.0. A value of the ratio H/D smaller than 0.5 will make it difficult to carry out the forging in the next step.

The metal mold used in the invention should have side walls and bottom wall made of a metal, although the hot top portion may be made of a heat insulating material such as bricks or sand mold.

It is not advisable to form the bottom of the metal mold with sand mold or brick because the solidification rate is undesirably lowered at the core portion of the ingot to permit confinement of the eutectic niobium carbides in the core portion of the ingot. The formation of the whole casting mold from sand mold is not preferred also because, by so doing, the segregation will appear in the surface of the ingot unfavourably.

When the molten metal is poured into the metal mold, the solidification starts with the portion contacting the metal mold. Before the solidification of the molten metal, the concentration of niobium is substantially uniform over the entire portion of the molten metal but, as the solidification goes on, the niobium content is increased at the central portion of the molten metal in the metal mold. If the height to diameter ratio H/D takes a large value, the solidification rate at the heightwise central portion of the ingot becomes larger than that in the upper portion of the ingot, so that the solidification in the heightwise central portion is completed to confine eutectic niobium carbides and non-metallic inclusions in the above-mentioned heightwise central portion. This is the reason why the eutectic niobium carbides become existed in the core portion of the ingot.

The solidification rate at the above-mentioned heightwise central portion can be decreased by decreasing the value of the ratio H/D. By so doing, it is possible to displace the molten metal rich in niobium back to the hot top portion to ensure the sound ingot. It proved that, in the production of ingot of an alloy steel containing 0.08 to 0.25 wt% of carbon, not greater than 0.15 wt% of niobium and 9 to 12 wt% of chromium, the molten metal rich in niobium is effectively moved to the hot top portion by making the ratio H/D not greater than 1.0.

Unexpected result of prevention of generation of sedimental crystals at the lower portion of the ingot was achieved by making the ratio H/D not greater than 1.0.

The prevention of generation of the sedimental crystals in turn makes it possible to utilize the whole part of the ingot as the material of the forged article and, hence, to remarkably improve the yield. From the view point of forgeability, the height to diameter ratio H/D most preferably ranges between 0.8 and 1.0.

In order to avoid any extinction of nitrogen and inclusion of oxygen, the ingot making step is conducted preferably under a vacuum of 50 mmHg or less.

(4) Forging

When the ingot has a height to diameter ratio H/D greater than 1, it is necessary to effect several cycles of upsetting forging in order to completely pressure-weld the defect such as shrinkage cavity remaining in the central portion of the ingot. In order to produce elongated large-size forged articles, therefore, it has been necessary to repeatedly conduct the upset forging and forging by applying radial load on the ingot, alternatively. It is to be pointed out that, in such an ingot, it is necessary to cut and remove the bottom portion of the ingot in which the sedimental crystals are formed.

In contrast, according to the invention, it is possible to reduce the number of cycles of upsetting forging or to completely eliminate the upsetting forging because the core portion of the ingot has no eutectic NbC nor defect such as shrinkage cavity. Furthermore, it is not necessary to cut the bottom portion of the ingot because no sedimental crystals are generated in the bottom portion of the ingot.

When the forged article to be produced has a diameter around 1300 mm, only one cycle of upsetting forging suffices. When the forging process containing one cycle of upsetting forging is conducted, at first the forging is conducted to compress the ingot in the radial direction and then an upset forging is conducted followed by another radial forging. In this way, the heightwise length of the ingot is gradually increased while the radial length of the same is gradually decreased. It is not preferred to effect the forging in such a manner as to reduce the heightwise length of the ingot while increasing the radial length of the same. In case where the forging is effected in such manner, the quality of the forged article is fluctuated along the length of the forged article. Such an article is not suitable for use as the material of steam turbine rotor shaft.

(5) Annealing

In order to uniformalize the structure and to attain good machinability, particularly the cutting machinability, the forged article is subjected to an annealing, preferably to a full annealing.

(6) Machining

The forged and annealed article is then machined by a cutting tool or the like into the size and form approximating those of the final product, i.e. the rotor shaft thereby to facilitate the cutting after the final heat treatment. Preferably, the rotor shaft is examined by means of, for example, an ultrasonic flaw detector after the machining.

(7) Hardening/Tempering

In order to impart strength and toughness (impact value, elongation and reduction of area) to the rotor shaft, a hardening and tempering are effected on the rotor shaft. The hardening temperature preferably ranges between 1000° and 1100° C., while the tempering temperature preferably ranges between 550° and 680° C. It is also preferred to rotate the rotor shaft in the circumferential direction, in order to attain uniform heating of the forged article.

After the completion of the hardening and tempering, examination is conducted again to check for any defect.

(8) Finishing

After the hardening and tempering, the steel ingot is machined again into the rotor shaft having final shape and size.

EXAMPLES

The ingot has a hot top portion annexed to an upper portion thereof. After the ingot making, the hot top portion is severed and cut off from the ingot. Usually, the ingot has an inversely tapered form for an easier separation from the metal mold, and the diameter D of the ingot at the heightwise mid point of the ingot after the separation of the hot top portion, i.e. at the heightwise mid portion of the body of the ingot, substantially coincides with the mean diameter of the ingot. In most cases, the body of the ingot has a cross-section which is circular form or corrugated circular form or a rectangular form approximating circular form. It is, therefore, possible to determine the diameter D assuming the cross-section as being circular.

An ingot having a diamter of about 500 mm was made from an alloy steel containing 0.02 to 0.15 wt% of niobium and 9 to 12 wt% of chromium, and was examined to investigate to which portion of the ingot the eutectic niobium carbides are concentrated. More specifically, the composition of this alloy steel was as follows: 0.17 wt%C, 0.30 wt%Si, 0.75 wt%Mn, 0.007 wt%P, 0.003 wt%S, 0.55 wt%Ni, 10.6 wt%Cr, 0.98 wt%Mo, 0.19 wt%V, 0.08 wt%Nb, 0.06 wt%N and the balance Fe.

As a result, it was confirmed that the eutectic niobium carbides are concentrated mainly around the V segregation. In order to clarify the reason why the eutectic niobium carbides are concentrated around the V-segregation, the solidification completion time for completing the solidification of the ingot and the temperature gradient at the time of completion of solidification were determined through calculation.

Figure 2:
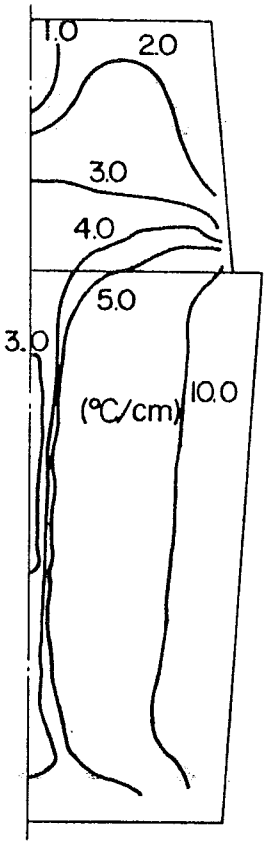
FIG. 2 is an illustration of the temperature gradient of the above-mentioned steel ingot at the time of completion of solidification.
Figure 1:
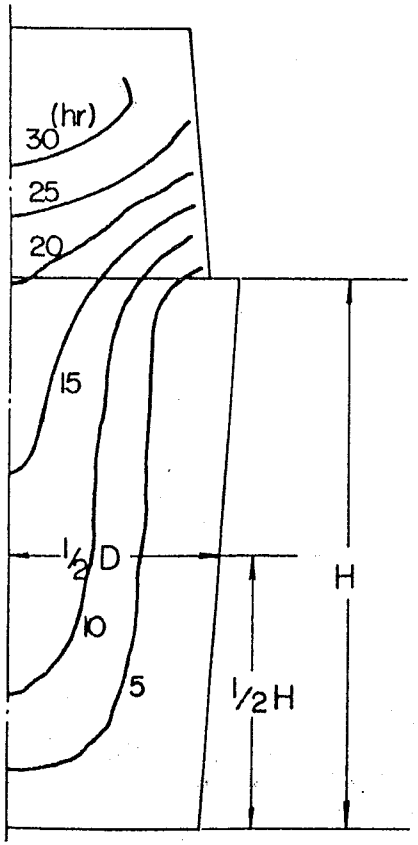
FIG. 1 is an illustration of solidification completion time and solidification completion line in a steel ingot made from 12 wt% chromium steel having a height to diameter ratio H/D of 1.35.

FIG. 1 shows the solidification time (hr) at a predetermined portion of 12 wt% chromium steel ingot having a height to diameter ratio H/D of 1.35 and a weight of 100 tons. The numerals in the drawings show the solidification time (hr) while the curves show the solidification front attained by predetermined times. FIG. 2 shows the temperature gradient (unit °C./cm) in the ingot at the time of completion of solidification. As will be clearly understood from FIG. 1, there is a region of large pitch of solidification completion lines in the region around the center of the ingot. This shows that the solidification is accelerated in this portion as compared with other portions. As will be seen from FIG. 2, the temperature gradient at the time of completion of solidification is comparatively small in the accelerated solidification region. In the model ingot mentioned before, the V-segregation, shrinkage cavities and the eutectic niobium carbides were generated in the central region of the ingot surrounded by lines of temperature gradient of 3° C./cm. Such region having small temperature gradient at the time of completion of the solidification cannot receive sufficient molten metal from the environment when making the solidification shrinkage, so that defects are formed often in such region. From the above-explained point of view, in order to exclude any eutectic niobium carbides, it is necessary to eliminate the accelerated solidification region in the core portion of the ingot to avoid formation of any region having small temperature gradient.

Figure 3:
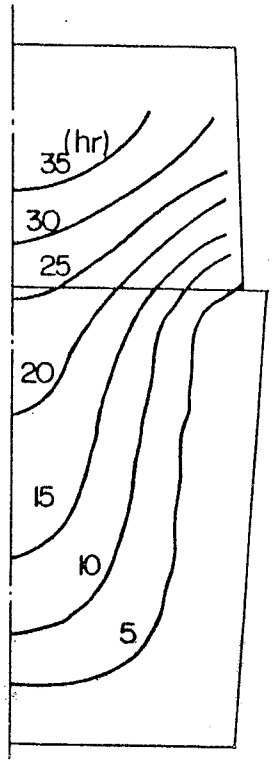
FIG. 3 is an illustration of solidification completion time and solidification completion line of steel ingot made from 12 wt% chromium steel having a height to diameter ratio H/D of 1.0.
Figure 4:
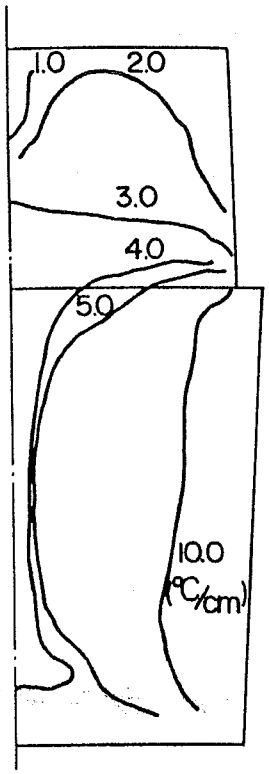
FIG. 4 is an illustration of temperature gradient of the above-mentioned ingot at the time of completion of solidification.

FIG. 3 illustrates the solidification completion line and solidification completion time (hr) as observed in the ingot molded from about 100 tons of 12 wt% chromium alloy steel having a height to diameter ratio H/D of 1.0. The composition of this alloy steel is identical to that of the alloy steel explained in connection with FIGS. 1 and 2. As will be understood from this Figure, the pitch of the solidification completion lines at the core portion of the ingot is much smaller than that shown in FIG. 1. FIG. 4 shows the temperature gradient (°C./cm) of the same ingot as that shown in FIG. 3 as observed at the time of completion of the solidification. In FIG. 4, the small region of small temperature gradient as shown in FIG. 2 can not be seen in the core portion of the ingot. This value 1.0 of the height to diameter ratio H/D is the upper limit value for preventing generation of V-segregation and shrinkage cavity in the central region of the large-size ingot. Namely, it proved that the V-segregation and the shrinkage cavity are generated when the ratio H/D takes a value exceeding 1.0, whereas no V-segregation and shrinkage cavity are formed nor the eutectic niobium carbides exist when the height to diameter ratio H/D takes a value smaller than 1.0.

The generation of the defects is suppressed to provide higher internal quality of the product as the value of the height to diameter ratio H/D is decreased but the smaller value of the ratio H/D makes the subsequent forging operation difficult. From the view point of forging, it is not preferred to reduce the value of the ratio H/D down below 0.5. According to the invention, the height to diameter ratio H/D takes a value preferably ranging between 1.0 and 0.5, in order to avoid presence of any eutectic niobium carbides.

Figure 5:
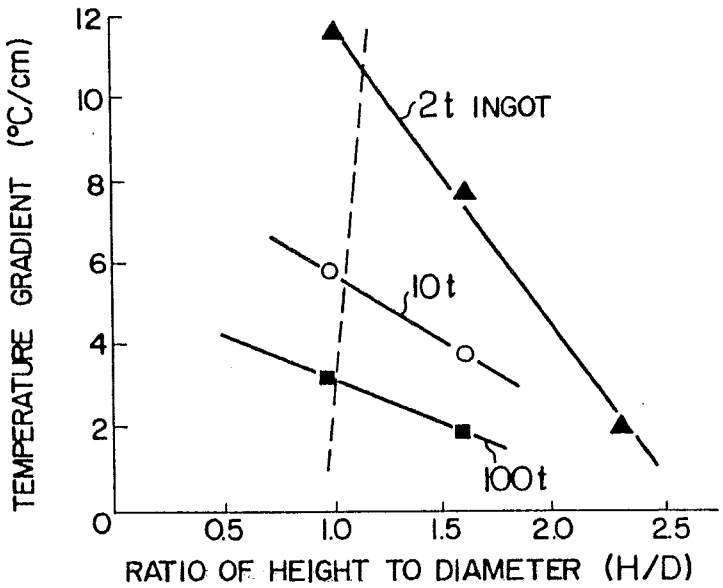
FIG. 5 is a graph showing the relationship between the amount of eutectic niobium carbides and the ratio of height to diameter (H/D) of the ingot.

FIG. 5 shows the result of calculation executed to examine how the temperature gradient at the time of completion of solidification in the portion having generation of eutectic NbC is varied by the height to diameter ratio H/D and the weight of the ingot. The area shown at the left side of the broken line represents the region having no eutectic NbC, whereas the area at the right side of the broken line is the region where the eutectic NbC exists. It is clear that, in the case of large-size ingot, the eutectic NbC does not remain in the body of the ingot if the ratio H/D takes a value not greater than 1.0.

EMBODIMENT 1

Ingots of about 13 tons and 10 tons, respectively, and having the height to diameter ratio H/D of 0.8 were formed from a 12 wt% chromium steel containing 0.17 wt% of C, 0.35 wt% of Si, 0.75 wt% of Mn, 11.0 wt% of Cr, 1.0 wt% of Mo, 0.2 wt% of V, 0.5 wt% of Ni, 0.06 wt% of N and the balance Fe. A macroscopic etching test was conducted with the 13 tons ingot. As a result, it proved that this ingot was sound ingot having no V-segregation and no shrinkage cavity, although slight microporosity was found. Also, no eutectic niobium carbides was found and the microsegregation was only slight. The 10 tons ingot was subjected to a forging in which it was pressed in radial direction to reduce its diameter D from the initial diameter 1260 mm down to 600 mm. No defect was found through an ultrasonic flaw detection test.

EMBODIMENT 2

Ingot of about 100 tons and having the height to diameter ratio H/D of 0.96 was made by using a metal mold and a turbine rotor shaft was produced from this ingot. The composition of the ingot was same as that in the Embodiment 1. In the ingot making, the constituents except the nitrogen were molten in an electric furnace and were degassed under a vacuum of 1 mm Hg or less within a ladle and then nitrogen was added to the molten metal. Subsequently, the moten metal was poured into the metal mold within an atmosphere of a vacuum of 20 to 30 mm Hg at a temperature of between 1590° and 1610° C. to obtain an ingot having a diameter of 2400 mm. The ingot was then forged at a temperature of 1150° C. to reduce the diameter to 1300 mm. The forging process applied included one cycle of upset forging and two cycles of radially compressing forging.

After the forging, the ingot was subjected to a full annealing and, after a cutting by a cutting tool, subjected to a hardening/tempering treatment. The hardening temperature and tempering temperature ranged between 1000° and 1100° C. and between 550° and 630° C., respectively. The thus treated material was then subjected to an ultrasonic testing, measurement of mechanical property and magnetic particle testing. No defect was detected through the ultrasonic testing. The measurement of the mechanical property was made with test pieces cut out from the rotor shaft material. The test results are shown in Table 1, from which it will be seen that both of the surface portion and the core portion of the rotor shaft have good mechanical property.

TABLE 1

| location | tensile strength (Kg/mm$^2$) | elongation (%) | reduction of area (%) | impact strength (Kg-m) | 0.02% proof strength (Kg/mm$^2$) |
|---|---|---|---|---|---|
| surface, radial | 93.0 | 17.0 | 50.1 | 2.8 | 71.2 |
| core, | 92.0 | 19.1 | 49.7 | 2.6 | 70.1 |

TABLE 1-continued

| location | tensile strength (Kg/mm$^2$) | elongation (%) | reduction of area (%) | impact strength (Kg-m) | 0.02% proof strength (Kg/mm$^2$) |
|---|---|---|---|---|---|
| transverse | | | | | |

The magnetic particle testing was conducted by forming a bore of 1.27 mm dia. at the center of the rotor shaft but no defect was detected.

After these examinations, a finish machining was conducted by means of a cutting tool to complete a rotor shaft having the maximum diameter of 1175 mm and overall length of 7980 mm.

As has been described, according to the invention, it is possible to eliminate any deterimental effect of the eutectic NbC and to avoid formation of sedimental crystals. Consequently, it is possible to produce rotor shaft for steam turbines without being accompanied by deterioration in the mechanical property.

What is claimed is:

1. A method of producing an elongated large-size forged article comprising: preparing molten metal of an alloy steel containing 0.08 to 0.25 wt% of carbon, 0.02 to 0.15 wt% of niobium, 9 to 12 wt% of chromium and more than 80 wt% of iron, pouring said molten metal and solidifying the same in a metal mold having a ratio H/D of the height H of the body neglecting the hot top portion to the diameter D at the height of ½ H falling within a range of not greater than 1, and forging the resulting ingot by applying pressure in the radial direction until the heightwise length of the forged article becomes greater than a diameter of the forged article.

2. A method of producing an elongated large-size forged article according to claim 1, wherein said body of said ingot has a diameter not smaller than 500 mm.

3. A method of producing an elongated large-size forged article according to claim 1, wherein said alloy steel consists of 9 to 12 wt% of chromium, 0.02 to 0.15 wt% of niobium, 0.08 to 0.25 wt% of carbon, 0.15 to 0.3 wt% in total of carbon and nitrogen, not greater than 0.5 wt% of silicon, 0.4 to 1 wt% of manganese, 0.7 to 1.5 wt% of molybdenum, 0.15 to 0.3 wt% of vanadium and the balance substantially iron.

4. A method of producing an elongated large-size forged article according to claim 1, wherein said alloy steel consists of 9 to 12 wt% of chromium, 0.02 to 0.15 wt% of niobium, 0.08 to 0.25 wt% of carbon, 0.15 to 0.3 wt% in total of carbon and nitrogen, not greater than 0.5 wt% of silicon, 0.4 to 1 wt% of manganese, 0.7 to 1.5 wt% of molybdenum, 0.15 to 0.3 wt% of vanadium, not greater than 1 wt% of nickel and the balance substantially iron.

5. A method of producing an elongated large-size forged article according to claim 3, wherein the chromium equivalent of said alloy steel ranges between 5.0 and 6.5.

6. A method of producing an elongated large-size forged article according to claim 4, wherein the chromium equivalent of said alloy steel ranges between 5.0 and 6.5.

7. A method of producing an elongated large-size forged article according to claim 1, wherein said ratio H/D ranges between 0.5 and 1.0.

8. A method of producing an elongated large-size forged article according to claim 1, wherein said ratio H/D ranges between 0.8 and 1.0.

9. A method of producing an elongated large-size forged article according to claim 1, wherein the forging is made by applying pressure to said ingot only in the radial direction thereof.

10. A method of producing an elongated large-size forged article according to claim 1, wherein the forging includes a plurality of forgings applying pressure to said ingot in the radial direction and one cycle of upset forging.

11. A method of producing a steam turbine rotor shaft comprising: preparing molten metal of an alloy steel containing 0.08 to 0.25 wt% of carbon, 0.02 to 0.15 wt% of niobium, 9 to 12 wt% of chromium and more than 80 wt% of iron, pouring said molten metal and solidifying the same in a metal mold having a ratio H/D of the height H of the body neglecting the hot top portion to the diameter D at the height of ½ H falling within a range of not greater than 1, forging the ingot by applying pressure in the radial direction until the heightwise length of a forged article becomes greater than a diameter of the forged article, subjecting the forged article to an annealing, subjecting the annealed forged article to a machining to form a half-finished rotor shaft, subjecting the machined half-finished rotor shaft to a hardening-/tempering treatment and subjecting the treated half-finished rotor shaft to a finish machining.

12. A method of producing a steam turbine rotor shaft according to claim 11, wherein said ratio H/D ranges between 0.5 and 1.0.

13. A method of producing a steam turbine rotor shaft according to claim 11, wherein said ratio H/D ranges between 0.8 and 1.0.

14. A method of producing a steam turbine rotor shaft according to claim 11, wherein said alloy steel consists of 9 to 12wt% of chromium, 0.02 to 0.15 wt% of niobium, 0.08 to 0.25 wt% of carbon, 0.15 to 0.3 wt% in total of carbon and nitrogen, not greater than 0.5 wt% of silicon, 0.4 to 1 wt% of manganese, 0.7 to 1.5 wt% of molybdenum, 0.15 to 0.3 wt% of vanadium and the balance substantially iron.

15. A method of producing a steam turbine rotor shaft according to claim 11, wherein said alloy steel consists of 9 to 12 wt% of chromium, 0.02 to 0.15 wt% of niobium, 0.08 to 0.25 wt% of carbon, 0.15 to 0.3 wt% in total of carbon and nitrogen, not greater than 0.5 wt% of silicon, 0.4 to 1 wt% of manganese, 0.7 to 1.5 wt% of molybdenum, 0.15 to 0.3 wt% of vanadium, not greater than 1 wt% of nickel and the balance substantially iron.

16. A method of producing a steam turbine rotor shaft according to claim 14, wherein the chromium equivalent of said alloy steel ranges between 5.0 and 6.5.

17. A method of producing a steam turbine rotor shaft according to claim 15, wherein the chromium equivalent of said alloy steel ranges between 5.0 and 6.5.

18. A method of producing a steam turbine rotor shaft according to claim 11, wherein the forging is made by applying pressure to said ingot only in the radial direction thereof.

19. A method of producing a steam turbine rotor shaft according to claim 11, wherein said forging is conducted by effecting both forging by applying pressure in the radial direction of said ingot and upset forging.

20. A method of producing a steam turbine rotor shaft according to claim 19, wherein said forging includes one cycle of upset forging and a plurality of forgings applying pressure to said ingot in the radial direction thereof.

21. A method of producing a steam turbine rotor shaft according to claim 11, wherein said molten metal is poured in said metal mold under a vacuum.

22. A method of producing a steam turbine rotor shaft according to claim 11 further comprising subjecting said molten metal of alloy steel to an electric furnace refining and a ladle refining.

* * * * *